US007810640B2

(12) United States Patent
Weston

(10) Patent No.: US 7,810,640 B2
(45) Date of Patent: Oct. 12, 2010

(54) LOCKABLE CONTAINER WITH INTEGRAL INTERNAL TRAY

(75) Inventor: Michael Weston, Chapel Hill, NC (US)

(73) Assignee: MeadWestvaco Corporation, Richmond, VA (US)

( * ) Notice: Subject to any disclaimer, the term of this patent is extended or adjusted under 35 U.S.C. 154(b) by 625 days.

(21) Appl. No.: 10/595,715

(22) PCT Filed: Nov. 19, 2004

(86) PCT No.: PCT/US2004/039032

§ 371 (c)(1),
(2), (4) Date: Aug. 27, 2007

(87) PCT Pub. No.: WO2005/051801

PCT Pub. Date: Jun. 9, 2005

(65) Prior Publication Data

US 2008/0314780 A1 Dec. 25, 2008

Related U.S. Application Data

(60) Provisional application No. 60/523,103, filed on Nov. 19, 2003.

(51) Int. Cl.
*B65D 73/00* (2006.01)

(52) U.S. Cl. ..... 206/485; 206/528; 206/483; 206/538; 229/125.125

(58) Field of Classification Search ..... 206/1.5, 206/528, 530, 531, 532, 539, 538, 485, 483; 229/125.125, 913; 220/8, 345.2, 345.3
See application file for complete search history.

(56) References Cited

U.S. PATENT DOCUMENTS

| | | | | |
|---|---|---|---|---|
| 955,041 | A | 4/1910 | Barell et al. | |
| 1,201,047 | A | 10/1916 | Hollingshead | |
| 1,253,489 | A * | 1/1918 | Houghland | 229/125.125 |
| 1,381,487 | A | 6/1921 | Maruny et al. | |
| 1,446,581 | A | 2/1923 | Pinkerton | |
| 1,726,732 | A | 9/1929 | Doran | |
| 1,803,028 | A | 4/1931 | Menten | |
| 2,035,803 | A | 3/1936 | Gilardi | |
| 2,426,856 | A * | 9/1947 | Berg | 229/122 |
| 2,426,899 | A | 9/1947 | Pantalone | |
| 2,426,911 | A | 9/1947 | Williamson | |
| 2,672,980 | A | 3/1954 | Hallback et al. | |
| 2,706,590 | A | 4/1955 | Bergstein | |
| 3,302,844 | A | 2/1967 | Warren | |

(Continued)

FOREIGN PATENT DOCUMENTS

| | | |
|---|---|---|
| CH | 534078 | 2/1973 |

(Continued)

*Primary Examiner*—David T Fidei
(74) *Attorney, Agent, or Firm*—MWV Intellectual Property Group

(57) ABSTRACT

Taught herein is a package for holding and securing various types of portable items. An inner slide card with integral tray (12) is loaded with items, and inserted into an outer sleeve (200). Receiving apertures (38) and securing tabs (40) hold and secure the items in the tray. An engaging element (42), integral to the slide card or tray cooperatively engages locking elements and stopping elements (240, 216) integral to the outer sleeve. The cooperative engagement of the elements provides an optional child-resistant feature and an optional spill-resistant feature. A release button (224) integral to the outer sleeve disengages the child-resistant feature.

24 Claims, 3 Drawing Sheets

U.S. PATENT DOCUMENTS

| | | | | |
|---|---|---|---|---|
| 3,606,006 | A | 9/1971 | Raybois | |
| 3,761,010 | A * | 9/1973 | Rosenburg, Jr. | 229/125.125 |
| 3,823,864 | A | 7/1974 | Ohkubo | |
| 3,921,895 | A | 11/1975 | Ziche | |
| 4,007,828 | A * | 2/1977 | Mayled | 206/1.5 |
| 4,076,117 | A | 2/1978 | Wisdom et al. | |
| 4,450,965 | A | 5/1984 | Paillet | |
| 5,088,599 | A | 2/1992 | Mahler | |
| 5,358,116 | A | 10/1994 | Brintazzoli | |
| 5,361,907 | A | 11/1994 | Mohrhauser | |
| 5,529,187 | A | 6/1996 | DeNola | |
| 5,752,605 | A | 5/1998 | Cooper | |
| 5,799,790 | A | 9/1998 | Ziegert et al. | |
| 6,047,829 | A | 4/2000 | Johnstone et al. | |
| 6,491,211 | B1 | 12/2002 | Evans et al. | |
| 6,685,226 | B2 * | 2/2004 | McKinney et al. | 283/56 |
| 6,830,147 | B2 * | 12/2004 | Coppola | 206/217 |
| 6,874,636 | B2 | 4/2005 | Paliotta et al. | |
| 7,097,042 | B2 | 8/2006 | Hsu | |
| 7,377,385 | B2 | 5/2008 | Giannini et al. | |
| 7,389,875 | B2 | 6/2008 | Sandberg et al. | |
| 2001/0040113 | A1 * | 11/2001 | Wong | 206/485 |
| 2002/0195814 | A1 * | 12/2002 | McKinney et al. | 281/29 |
| 2003/0047482 | A1 | 3/2003 | Jones et al. | |
| 2003/0085262 | A1 | 5/2003 | Evans et al. | |
| 2004/0050724 | A1 * | 3/2004 | Grul et al. | 206/217 |
| 2005/0205437 | A1 * | 9/2005 | Huffman et al. | 206/217 |
| 2008/0135606 | A1 | 6/2008 | Weston et al. | |

FOREIGN PATENT DOCUMENTS

| | | |
|---|---|---|
| EP | 1002744 | 12/2005 |
| GB | 2042476 A * | 9/1980 |
| WO | WO03101840 | 12/2003 |

* cited by examiner

LOCKABLE CONTAINER WITH INTEGRAL INTERNAL TRAY

CROSS-REFERENCE TO RELATED APPLICATION

This application claims priority to co-pending U.S. Provisional application 60/523,103, filed on Nov. 19, 2003. The entire disclosure of that prior filed application is hereby incorporated by reference.

FIELD OF THE INVENTION

This invention relates to a two-piece package, which houses portable items on an inner slide card with integral tray configured to be inserted into an outer sleeve. This package may have one or more internal or external locks that prevent the slide card from being pulled out of the sleeve. This senior-friendly package may include a child-resistant feature and a spill-resistant feature, in a package that can be opened and closed numerous times to access the items on the tray.

BACKGROUND OF THE INVENTION

Conventional pharmaceutical packaging has shortcomings with regard to drug delivery devices, which create problems for both the manufacturer and end user. For example, it is known to distribute devices including syringes, vials, ampoules, test tubes, and similarly shaped elongated components in packaging that incorporates foam or plastic elements to separate and pad the device or device component. The manufacturer that incorporates foam or plastic elements in its packaging to protect the device carries an increased inventory and employs a more complicated manufacturing system to produce its packaging. Further, the conventional manufacturer typically produces one kind of package to be filled by automated means and another kind to be filled by hand, which increases inventory and the number of product lines.

In addition, conventional manufacturers pack drug delivery devices tightly and in the most efficient manner possible—from the perspective of shipping cost savings—at the expense of the end user who has limited physical mobility, such as an end user with arthritis of the fingers. Such conventional packaging normally orients the device in the difficult to access vertical position; and, where conventional packaging orients the device in a horizontal position the devices are typically stacked directly on top of each other. It is also known to distribute such devices loose—or loose, but individually wrapped—in conventional boxes without a means for holding and securing the devices.

Conventional manufacturers of drug delivery device packaging typically do not provide a child-resistant feature to prevent unauthorized access, or a stopping feature to prevent accidental spillage of the stored products. Where these features do exist, they exist at the expense of easy access for the end user with limited dexterity. Neither does the known drug delivery device packaging provide ample space to place consumer information in the form of appropriately sized graphics, an integral holder for data storage such as a pamphlet or mini-disc, or instructional indicia adjacent to each device. Also conventional manufacturers are not known to mix devices but only distribute similar devices together. This convention requires the end user with a complicated drug regimen to create and maintain an unnecessarily extensive inventory of drug delivery devices to fill their needs.

End users are familiar with the disposal problems created by the use of drug delivery devices. Typically, spent vials, ampoules, test tubes, and components must be sealed or otherwise protected in order to be disposed of safely. While it is known to dispose of needles in a separate sealable and rigid container, there remains a need for packaging that serves as a safe means of disposal for similar devices, such as spent containers.

It is apparent from a survey of the packaging arts that there exists a need for a system and apparatus that secures and protects items such as drug delivery devices and components thereof, allows for improved manufacturing processes, may include child-resistant and spill-prevention features, stores a variety of items in response to the end users' needs, is fitted for easy access by the end user with limited dexterity, has sufficient area to receive graphics and related information, and provides a means for safe disposal.

SUMMARY OF THE INVENTION

The present invention fulfills the needs identified above by providing packaging that comprises an outer sleeve and an inner slide card with an integral tray releasably retained within the outer sleeve. In some embodiments, both the outer sleeve and inner slide card with tray comprise a means for engaging configured to cooperatively engage the other to create a means for locking, means for releasing, and means for stopping.

In exemplary embodiments, a means for engaging includes panels, tabs, catches, ribs, abutments, edges, cutouts, apertures, and like elements, integral to or attached to the card, configured to connect with similar means for engaging elements associated with the outer sleeve, and referred to herein together as a means for locking. A means for releasing includes panels, tabs, ribs, abutments, edges, cutouts, catches, apertures, and like elements, integral to or attached to the outer sleeve, configured to uncouple engaged or locked elements. With a means for locking and a means for releasing, the present invention provides an optional child-resistant feature. A means for stopping includes panels, tabs, ribs, catches, abutments, apertures, edges, cutouts, and like elements, integral to or attached to the card, configured to matingly engage similar elements associated with the outer sleeve. With a means for stopping, the present invention provides an optional spill-resistant feature to prevent the user from pulling the tray completely away from the outer sleeve.

Embodiments include a system and method for holding and securing portable items, such as drug delivery devices, by providing a slide card with tray configuration that holds and secures a device, allows easy access to the device for removal and replacement; and collects and stores the spent devices. Accordingly, embodiments of the present invention provide a system and apparatus that is able to safely ship drug delivery devices for transepidermal, oral, or hypodermic administration, including pre-filled syringes, vials, ampoules, test tubes, patches, inhalers, and parts thereof, and like devices, safely store the unused devices, and safely store the used devices until all can be safely disposed as a unit.

Alternative embodiments include an apparatus and method for providing product instructions, such as compliance directions and patient information literature (PIL). In one embodiment, indicia—such as but not limited to time of day, days of the week, numerical sequence, or dosage amounts—is positioned adjacent to the devices. In another embodiment, information is positioned on or in the inner slide card or outer sleeve in a manner easily visible by the user. One embodiment for securing Information comprises a pocket integral to the outer sleeve, while another embodiment comprises a computer disc receiving mount.

Another embodiment of the present invention comprises a slide card with an integral tray and integral engaging tab, wherein the tray is configured to receive and hold at least one portable item. An outer sleeve that receives the card with tray comprises a locking edge configured to engage the tab at a locking position. Here the outer sleeve defines a void configured to receive the card and tray, and comprises a means for engaging the card's means for engaging. The outer sleeve also includes a means for releasing, configured to uncouple the means for locking created by the coupling of the respective means for engaging.

A method for resisting access to an item secured in an embodiment of the present invention comprises the following steps, presented in the following order merely for the purposes of teaching and not limitation. Provide a slide card with an integral tray and means for engagement. Provide a tray comprising at least one receiving recess, and place an item in the recess. Provide an outer sleeve with an open end, an accessible void, and a means for engaging the card. Align the card with the open end and orient the respective means for engaging to create a means for locking. Insert the card fully into the void to cause the respective means for engaging to releasably lock.

Embodiments according to this invention offer at least the following advantages: lightness in weight, resistance to tampering, child-resistance, ease of access, excellent durability, ease of manufacturing and assembly, device protection, ease of storage, ease of disposal, the ability to present devices of varied and unusual shapes, and excellent economy.

DETAILED DESCRIPTION OF THE INVENTION

As required, detailed embodiments of the present invention are disclosed herein. It will be understood that the disclosed embodiments are merely exemplary of the invention that may be constructed in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not to be interpreted as limiting, but as a basis for the claims and for teaching one skilled in the art to variously employ the present invention.

Figure 1:
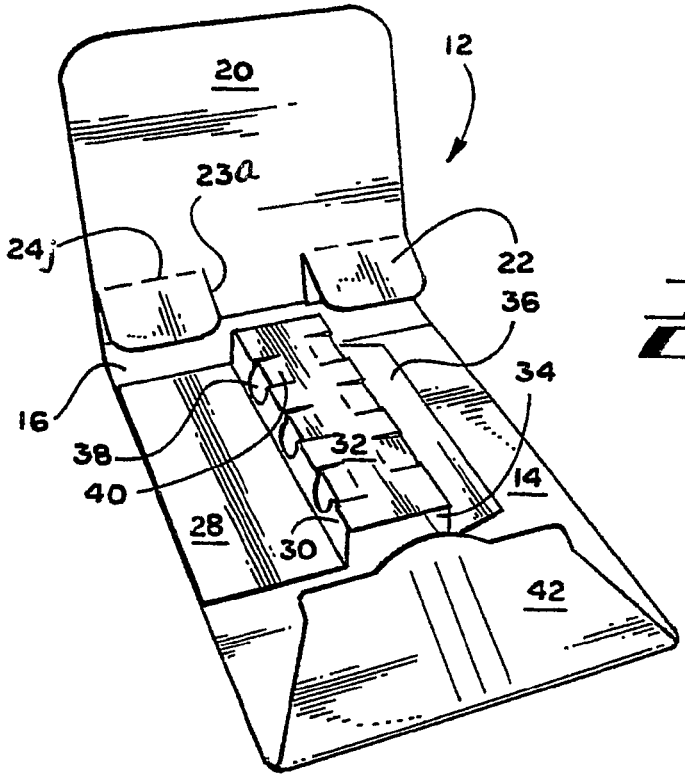
FIG. 1 is an isometric view of an embodiment of an inner slide card with integral tray.
Figure 2:
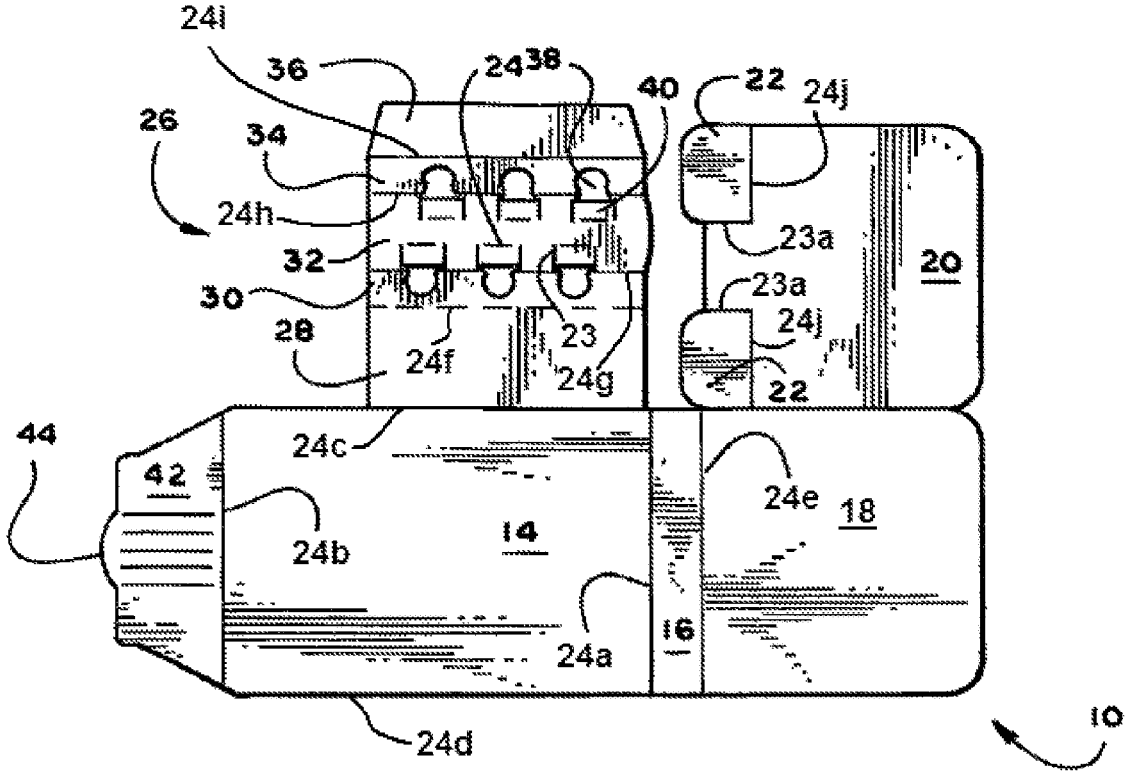
FIG. 2 is a plan view of the blank of the inner slide card of FIG. 1.

Referring now to the drawings, wherein like numerals represent like features throughout, there are illustrated embodiments of the present invention. Turning first to FIG. 1 and FIG. 2, there is shown a slide card blank 10 configured to form an inner slide card with integral tray 12 configured to receive and store an item, such as a drug delivery device.

Herein, the phrase "drug delivery device(s)" is used broadly to refer to all apparatus and parts thereof used in conjunction with transferring substances into or out of a body, such as but not limited to a human being. By way of example and not limitation, a drug delivery device comprises a substance in the form of, or contained within, pills, tablets, suppositories, chewables, aerosols, inhalers, transdermal patches, injectable devices, parts thereof, and the like. Injectable devices comprise components such as syringes, vials, ampoules, and the like, that may be used by a medical professional to treat a patient with a pharmaceutical drug, or the patient to treat him or herself. For purposes of teaching and not limitation, the illustrated embodiments are configured to receive and store a drug delivery device in the form of injectable devices, but those skilled in the art will immediately understand that the tray may be configured to hold any portable item.

As best shown in FIG. 2, the illustrated slide card blank 10 comprises a base panel 14, spine panel 16, inside top panel 20 and outside top panel 18. The base panel 14 is defined by first 24*c* and second 24*d* opposed edges and third 24*a* and fourth 24*b* opposed edges. An extension panel 26 is foldably attached to the base panel 14 along the first edged 24*c* to provide a tray on the base panel. The spine panel 16 is foldably attached to the base panel 14 along the third edge 24*a* and extends to a spine panel edge 24*e* opposed to the third edge 24*a* . The outside 18 top panel is foldably attached to the spine panel 16 along the spine panel edge 24*e* , and the inside top panel 20 is foldably attached to the outside top panel 18. The inside top panel 20 comprises two integral spine support panels 22 formed by cut lines 23*a* and fold lines 24*j*. Depending upon the material used to construct the card, fold lines 24*a*-24*j* are formed by scores, cuts, bends, perforations, live hinges, formed hinges, and the like. The extension panel 26 comprises a first securing section 28, a first sidewall section 30, a top section 32, a second sidewall section 34, and a second securing section 36. These sections 28,30,32,34,36 are separated by fold lines 24*f*/24*i*.Further, sidewall sections 30, 34 comprise at least one receiving aperture 38 while top section 32 comprises at least one securing tab 40. Alternative receiving aperture configurations are described below to illustrate a means for securing to a tray.

Blank 10 further includes engaging tab 42 with engaging edge 44. As described in detail below, engaging tab 42 cooperatively engages with another element to create a child-resistant feature, and with yet another element to create a pull-out stop that also functions as a spill-resistant feature. Thus tab 42 may function as a means for engaging that is part of a means for locking and/or as part of a means for stopping, by cooperatively engaging with a first element to create the child-resistant feature or cooperatively engaging with a second element to create the spill-resistant feature.

With regard to choice of materials, the blank 10 may comprise paper, paperboard, cardboard, plastic, or combinations thereof. Where the blank 10 comprises paperboard, bleached sulphate, solid unbleached sulphate, or clay-coated newsback are well-known design choices. Typically the paperboard coating is a fluid blend of materials, such as coating clay, calcium carbonate, and/or titanium dioxide with starch or adhesive smoothly applied to the traveling surface. Successive densification and polishing finish the mineral-coated surface to a superior, graphic-print surface. When the card and/or tray is plastic, fabrication techniques well known to those skilled in the art, including thermo-forming, injection molding, and the like, are contemplated. Where the slide card 10 is plastic, the fold-lines 24, 24*b* may be live hinges, or, as explained below regarding the engaging feature of the tab 42, fold-line 24*b* may be a formed hinge with an upwardly or downwardly extending profile to create an internal spring tension that urges the tab 42 back toward a relatively relaxed or horizontal orientation after the tab 42 is first folded over toward base panel 14.

With regard to assembly, blank 10 may be folded and connected, using conventional techniques, to create the slide card with integral tray 12, best shown in FIG. 1. One sequence of folding and connecting is as follows, with reference to the visible side of the illustrated blank 10 as the face and the opposite side as the back. The inside top panel 20 is folded with respect to the outside top panel 18 and the face of the panel 20 is affixed to the face of outside top panel 18 so that inside 20 and outside 18 top panel together provide a single top cover. When the inside top panel 20 is folded over the outside top panel 18, the face of spine support panel 22 (or panels 22, where a particular embodiment has more than one spine support) overlaps the face of spine panel 16. The extension panel 26 is folded to form the integral tray. The steps of creating the integral tray may comprise affixing the face of the first securing section 28 to the face of the base panel 14, folding the first sidewall section 30, top section 32, and second sidewall section 34 toward each other to form a sleeve or open-end channel. With the faces of sections 30 and 34 oriented toward each other, the face of second securing section 36 may likewise be attached to the face of base panel 14. In addition, as described below, engaging tab 42 may be folded so that the face of engaging tab 42 is oriented toward the face of base panel 14.

After assembly, the illustrated tray 12 is configured to receive and store an injectable device such as a vial or ampoule (not shown), shaped, for the purpose of teaching and not limitation, such that a neck is narrower than the body or top. The tray comprises a means for holding the device, such as the rounded receiving aperture 38. The device may be held within the tray by positioning the neck within the receiving aperture 38 and allowing the body to rest on the backs of the securing panels 28, 36. Here, the aperture 38 is rounded because this shape holds a container neck in a particular position while allowing easy access. Those skilled in the art will understand that the aperture 38, as a means for holding, may be configured in various shapes, depending on the device and ease or complexity of access desired. For example, this means for holding may be in the shape of an hour-glass, or "J," or "L," or "G," or "H," all of which provide varying levels of security and access for the items.

The top panel 32 comprises at least one securing tab 40, proximate to the aperture 38, configured to cooperatively engage and secure the device within the tray 12. This securing tab 40, functioning as a means for resisting removal, may be configured to lock in or otherwise secure the item in the aperture. By way of example and not limitation, this means for resisting removal may be a securing tab proximate to the aperture, a fold-over locking flap above or behind the aperture, a strap over the aperture, an insert of different materials such as plastic or rubber yokes within the aperture, and the like, all of which serve to resist removal of the device.

Those skilled in the art will understand that the aperture 38, as a means for holding, and the securing tab 40, as a means for resisting removal, may be configured in various shapes depending on the device and ease or complexity of access desired, without departing from the scope of the claims. To that end, depending upon the shape and size of the devices to be held on the tray, various configurations of a means for holding and a means for resisting removal—whether those configurations are shaped to hold similar or different devices—may be formed in extension panel 26 so that the related tray is configured to hold and secure the intended devices.

Figure 3:
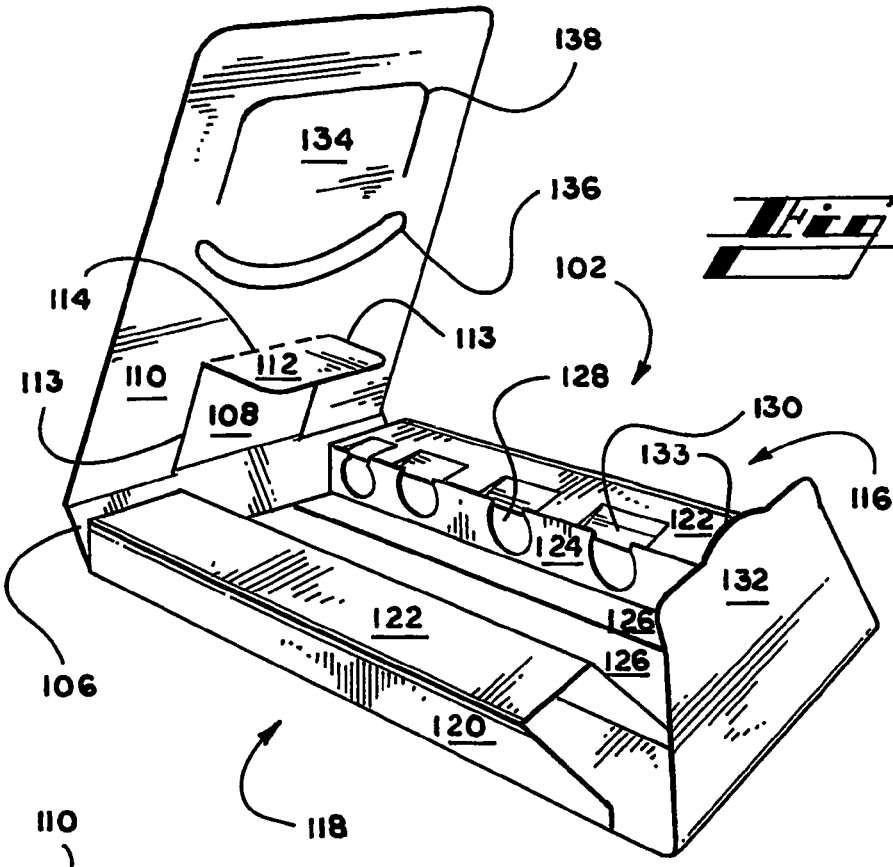
FIG. 3 is an isometric view of an alternative embodiment of an inner slide card with integral tray.
Figure 4:
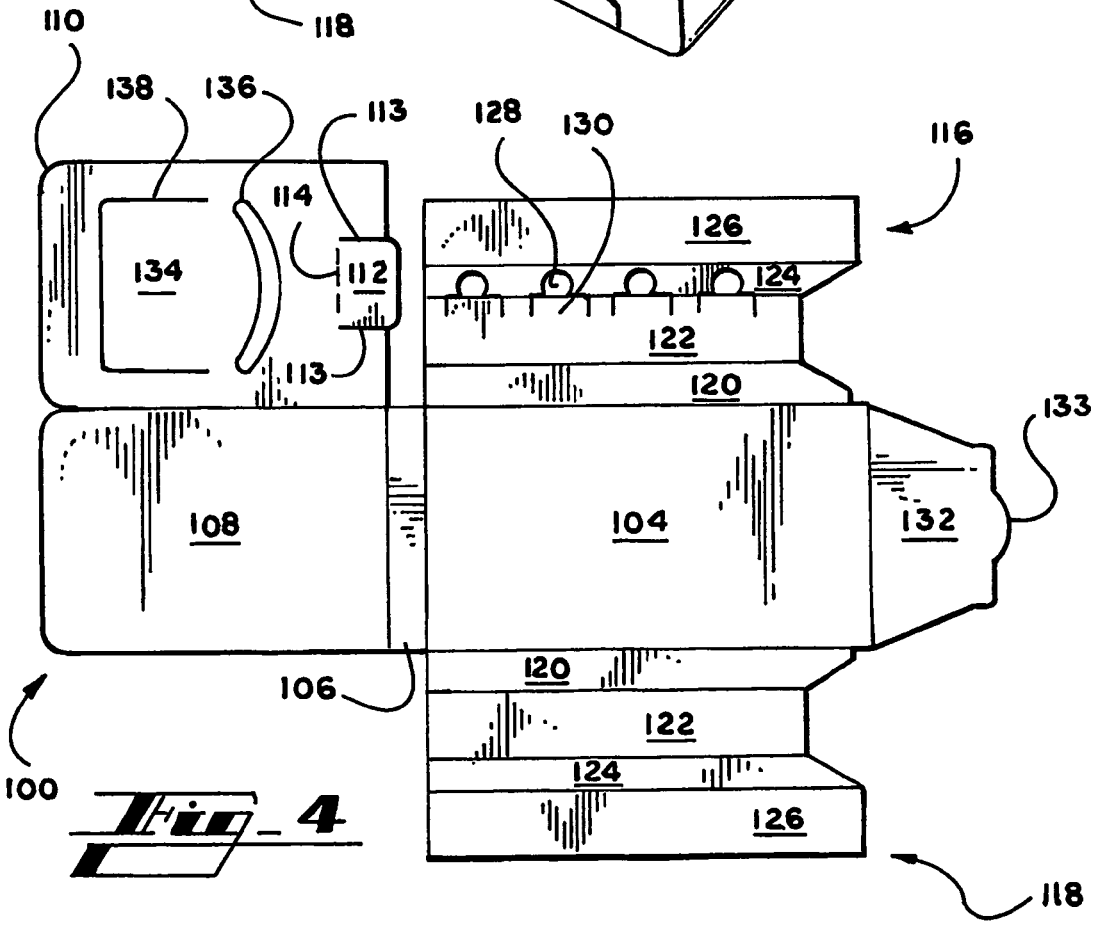
FIG. 4 is a plan view of the blank of the inner slide card of FIG. 3.

FIG. 4 shows an alternative embodiment of a card blank 100 that, when assembled, forms the inner card with integral tray 102 shown in FIG. 3. The illustrated blank 100 comprises a base panel 104, spine panel 106, inside top panel 110 and outside top panel 108. The top panel 110 comprises a spine support panel 112 formed by cut lines 113 and fold lines 114. Blank 100 further comprises first extension panel 116 and second extension panel 118.

The extension panel 116 comprises first sidewall section 120, a top section 122, a second sidewall section 124, and a securing section 126. Further, sidewall section 124 comprises at least one receiving aperture 128 while top section 122 comprises at least one securing tab 130. For the purposes of teaching and not limitation, the extension panels 116, 118 are Illustrated with different configurations. Here, panel 116 comprises both a means for holding and a means for resisting removal, while panel 118 has neither. Those skilled in the art will understand that, in this embodiment, panel 118 serves to add rigidity to the package and protect the devices held and secured by panel 116. Further, they will understand that panel 118 may likewise be configured to comprise a means for holding and a means for resisting removal.

Blank 100 further comprises engaging tab 132 with engaging edge 133. Similar to engaging tab 42 with edge 44 described herein, engaging tab 132 cooperatively engages with another element to create a child-resistant feature, and with yet another element to create a pull-out stop that also functions as a spill-resistant feature. Thus tab 132 may function as a means for engaging that is part of a means for locking and/or as part of a means for stopping, by cooperatively engaging with a first element to create the child-resistant feature or cooperatively engaging with a second element to create the spill-resistant feature.

With regard to assembly, blank 100 may be folded and connected, using conventional techniques, to create the slide card with integral tray 102 best shown in FIG. 3. One sequence of folding and connecting is as follows, with reference to the visible side of the illustrated blank 100 as the face and the opposite side as the back. The face of top panel 110 is folded and affixed to the face of top panel 108 so that the face of spine support panel 112 overlaps the face of spine panel 106. The extension panels 116, 118 are folded to form the integral tray. The steps of creating the integral tray may comprise folding the first sidewall section 120, top section 122, and second sidewall section 124 toward each other to form a sleeve or open-end channel. With the faces of sections 120 and 124 oriented toward each other, the face of securing section 126 may be attached to the face of base panel 104. In addition, as described below, engaging tab 132 may be folded so that the face of engaging tab 132 is oriented toward the face of base panel 104.

Here the trays 12, 102 are configured to allow for easy access to the items being held and stored. By way of Illustration and not limitation, the devices may be arranged so that the end user, who may have limited physical mobility such as arthritis, can retrieve one device without affecting another. For example, orienting an item horizontally and with its widest part splayed across the panel 14, 104 or sections, 28, 36, 126, provides the greatest accessibility to the item, which is a desirable feature of certain embodiments. Such horizontal orienting also provides easy viewing of the devices so the user may easily distinguish between them. Further, such orienting provides ample area to receive graphics. For example, dosage regimen instructions including date, day, and time may be formed on the tray sections between or adjacent to the recesses. Alternatively, the items held on the tray may be as closely packed and aligned as desired.

User information such as dose compliance, warnings, instructions, patient Information literature (PIL), and similar data in written or digital form can be made easily visible or accessible to the user through the ample billboard space found on either side of the many panels described herein. In one embodiment, best shown in FIG. 3 and FIG. 4, there is shown a means for data storage, which receives and stores data mediums. Here data storage 134 is formed by semi-circular storage cut line 136 and storage score line 138, in inside top panel 110. When inside top panel 110 is folded over and affixed to outside top panel 108, cut line 136 and score line 138 provide a receiving slot and storage sleeve for receiving and storing information such as may be provided in a brochure or an electronic disc. Another means for data storage includes an electronic disc mount for securing the disc hub of a CD or mini-DVD, and may be positioned on any of the panels described herein.

Figure 6:
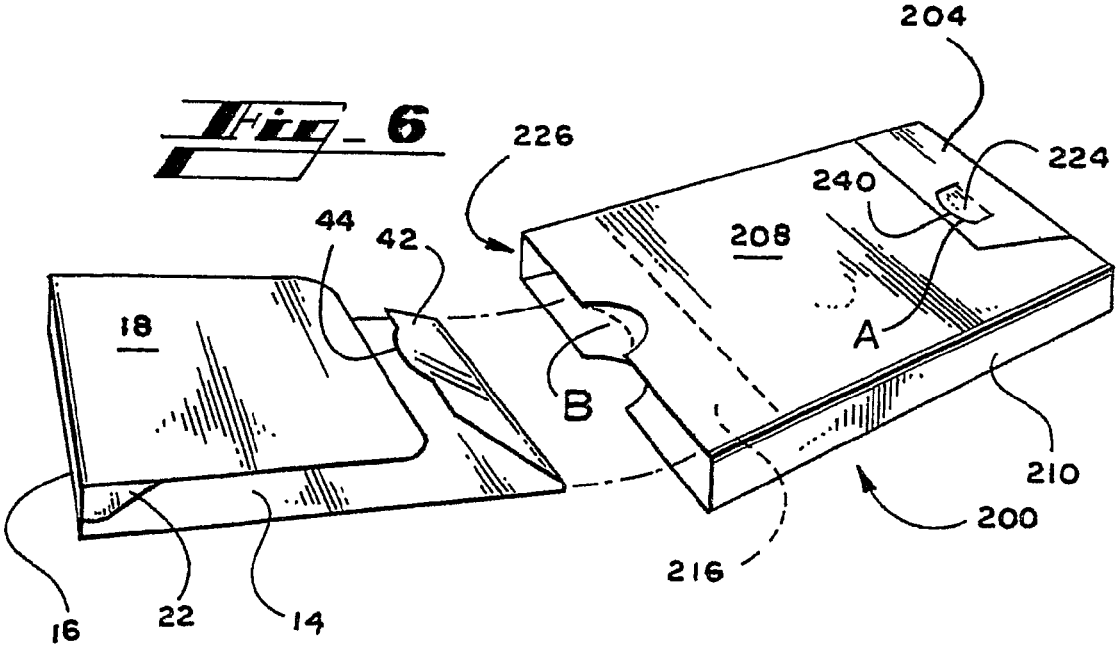
FIG. 6 is an isometric view of a constructed embodiment of the present invention.
Figure 5:
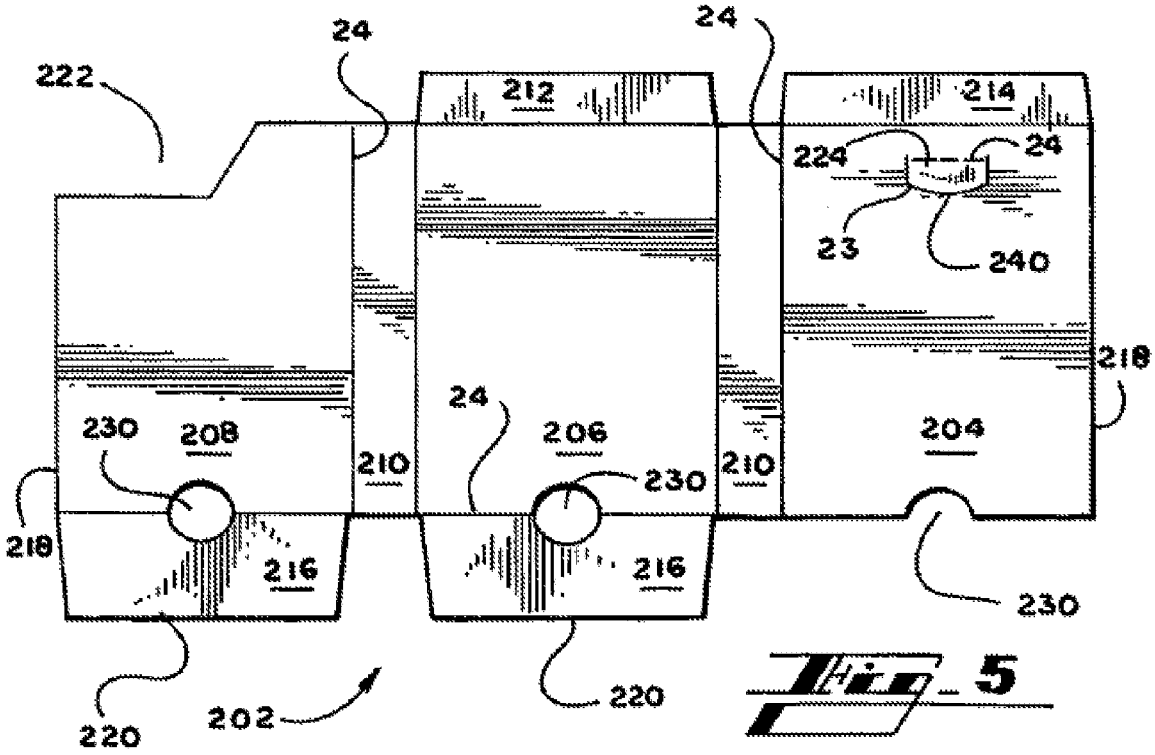
FIG. 5 is a plan view of an embodiment of an outer sleeve blank.

Turning now to FIGS. 5 and 6, there is shown an outer sleeve 200 for receiving the Inner card with integral tray 12, 102, and the related outer sleeve blank 202. As best shown in FIG. 5, the illustrated blank 202 includes side panels 204, 206, 208, spine panels 210, end panels 212, 214, and extension panels 216. The panels are defined by the respective adjacent fold lines 24 and respective outer edge 218. Extension panel 216 includes outer edge 220. In addition, side panel 208 includes an indent 222, which, as explained below, is configured to surround or otherwise avoid the release button 224 located on side panel 204. The release button 224 is defined by cut line 23 and fold line 24. Side panel 204 also comprises an internal engaging edge 240, created by the cut line 23 that defines the release button 224, that defines a means for engaging.

With regard to assembly, the blank 202 is folded and connected using conventional techniques to create the outer sleeve 200, best shown in FIG. 6 as a slip case defining a void 226. One sequence of folding and connecting the blank 202 is as follows, with reference to the visible side of the illustrated blank 202 as the face and the opposite side as the back. Side panel 208 is folded, along fold lines 24, under the side panels 206, 204 and then positioned over panel 204 so that the back of panel 208 may be affixed to the face of panel 204. In this embodiment panel 208 is overlayed and affixed to panel 204 so that the indent 222 of panel 208 surrounds or otherwise avoids the release button 224. In other words, the release button 224 is unobstructed by panel 208.

Extension panels 216 are folded inwardly to extend into the void 226 so that edges 220 float freely to define a means for engaging, and end panels 212, 214 are folded inwardly so that the face of one end panel may be affixed to the back of the other to form the end wall of the slip case. In some embodiments the back of panels 216 are affixed to the backs of the respective adjacent side panels 204, 206. In those embodiments the edges 220 are immediately adjacent to the backs of panels 204, 206 and act, as described below, as a means for engaging. The cutouts 230 form finger-access areas when panels 216 are folded.

In practice, and with reference to FIGS. 1 and 6, items are placed within the tray and the various panels and tabs are folded before the inner card with integral tray 12, 102 is inserted into the void 226 of outer sleeve 200. This container holds and protects the Items until they are retrieved for use. In the example of drug delivery devices holding a unit dose, the Illustrated Unit Dose Packaging System (UDPS) secures these devices until they are retrieved for use. For purposes of teaching and not limitation, the following folding sequence is described. Top panel 20 is folded so as to cover the tray and the spine support panel 22 is oriented to be adjacent to spine 16, so as to provide support for the spine 16. In the illustrated embodiment, the back of top panel 20 is now adjacent to the items and substantially parallel to panel 14. Further, engaging tab 42 is folded Inwardly so that the face of tab 42 is close to or touching the face of base panel 14. With the inner card folded as described, it is inserted into the void 226, through the open end, starting with the edge formed by the fold line 24*b*, and with tab 42 receivingly aligned with release button 224, as illustrated in FIG. 6.

The card with tray 12, 102 may be fully inserted into the outer sleeve 202, to a fully closed position. With continued reference to FIG. 6 and as understood by those skilled in the art, the spring tension created by the inwardly folded tab 42 causes the engaging edge 44 to press against the interior of the void 226 along panel 204. Two particular points of contact along the interior of the void will be noted. At the fully closed position the engagement of tab edge 44 with the internal edge 240 creates the means for locking at position A that provides the child-resistant feature. From a fully opened position, the engagement of the tab edge 44 with the interior of the folded extension panel 216 creates the means for stopping at position B that provides the spill-resistant feature. It will be understood that an embodiment may be constructed without either or both of the child-resistant or spill-resistant features.

In the illustrated embodiment a means for releasing includes the release button 224. The spring tension created by the folded tab 42 causes the leading edge of tab 44 to engage the internal edge 240 of the panel 204. With the edge 44 and edge 240 engaged, the inner card with integral tray is locked within the outer sleeve 200 and cannot be accessed; this means for locking creates a child-resistant feature. To unlock the child-resistant feature of this embodiment and thereby release the card with tray, the user depresses the release button 224, which in turn depresses the tab 42 to disengage the edge 44 from the edge 240.

After releasing the optional child-resistant feature the card with tray 12 may be extracted from the outer sleeve 200 to a fully open position. In the illustrated embodiments, a fully open position occurs when tab 42 engages the interior of floating extension panel 216 at stopping position B. As will be understood by those skilled in the art, the spring tension created by the folded tab 42 causes the tab 42 to engage the interior of the floating extension panel 216. Once engaged, the card with tray 12 cannot be further removed from the outer sleeve 200 but may be reinserted to a fully closed position if desired. In this manner, this means for stopping acts as a spill-resistance feature to prevent the card with tray 12 from being pulled completely out of outer sleeve 200.

It will be understood that a means for releasing, a means locking, and a means for stopping, are contemplated in various combinations in various embodiments. For example, in the illustrated embodiment the extension panel 216 is not attached to side panel 204, but is allowed to extend downwardly into the void 226 to catch and engage the folded tab 42, thereby forming a means for stopping. In an alternative embodiment the extension panel 216 is folded inwardly and the respective backs of the panels 216, 204 are attached so that the extension panel edge 220 abuts engaging edge 44, thereby forming a means for stopping. In the illustrated embodiment the release button 224 and edge 44 have similar profiles, a feature that facilitates engagement of the respective edges 240, 44 and forms a means for locking. In alternative embodiments any edge or protrusion within the void 226 configured from panels, tabs, cutouts, ribs, offsets, catches, apertures, abutments, edges, and like elements, that engage similar elements such as the tab 42 or tab edge 44, forms an alternative means for locking or an alternative means for stopping. In yet another embodiment, a means for engaging is integral to or connected to the extension panels 26, 116, 118 to create a means for locking and a means for stopping.

The user may open and close the container by withdrawing and replacing the card with tray 12, 102 within the outer sleeve 200 as often as desired. Regarding the illustrated embodiments, from the locked position A the user grasps the card with tray 12 at the top panel 18 and base panel 14, both adjacent to the spine panel 16, from the access cutouts 230 provided in side panels 204, 206, 208. The user then depresses the release button 224 in order to disengage the means for locking. Continuing to depress the button 224 while grasping and pulling laterally will withdraw the tray from the sleeve 200. From the stopped position B the user may fold back the optional top panel 20 to access an item held in the tray. After accessing the desired item, the user folds the top panel 20 back over the tray and reinserts the card with tray 12 within the sleeve 200 for future use.

An embodiment designed to be disposed of, together with used injectables, may be placed within a red plastic bag (not shown but provided with the embodiment) thereby giving notice of the contents. By way of illustration and not limitation, additional means for protecting and sealing an embodiment to be disposed of, together with used injectables, include sealable bags, a self-sealing outer sleeve, a sealable outer sleeve large enough to receive the inner card with tray and outer sleeve 200. Similarly, taping the card within the outer sleeve with red tape giving notice of the contents is another means for protecting and sealing.

It is contemplated that the present invention is not limited to the pharmaceutical-related goods illustrated, but is applicable to a plethora of delicate, sensitive, or unique portable goods. By way of example and not limitation, small electronic components, jewelry, foods, expensive and precious articles, and any other item that requires a safe, stable, and portable environment in which to be shipped and stored may find an application with the present invention. Further, it will be understood that variations, modifications, and enhancements can be made to the disclosed apparatus and methods without departing from the scope of the present invention as defined in the following claims.

I claim:

1. A system for receiving and securing an item, comprising:

a slide card and an outer sleeve, the slide card comprising:

a base panel defined by first and second opposed edges and third and fourth opposed edges;

an extension panel foldably attached to the base panel along the first edge and folded to provide a tray on the base panel;

a card spine panel foldably attached to the base panel along said third edge and extending upward to a spine panel edge opposed to the third edge;

a top cover foldably attached to the card spine panel along the spine panel edge and disposed over the tray;

at least one spine support panel formed at least in part from the top cover, the at least on spine support panel extending downward from the top cover toward the card spine panel so as to provide support for the card spine panel, the outer sleeve comprising:

a first side panel attached to an adjacent first spine panel, a second side panel attached to said first spine panel, a second adjacent spine panel attached to the second side panel, and at least one end panel attached to at least one of said first and second side panels; and, wherein said outer sleeve defines a void configured to receive said slide card.

2. The system of claim 1, wherein the extension panel comprises at least one securing section, a pair of sidewall sections and a top section connected in series by fold lines.

3. The system of claim 2, wherein said at least one securing section is affixed to said base panel such that said sidewall sections are substantially parallel to each other.

4. The system of claim 3, wherein said slide card further comprises a first engaging element foldably attached to the base panel along the fourth edge.

5. The system of claim 4, wherein said outer sleeve further comprises a second engaging element configured to releasably engage said first engaging element to lock the slide card within the outer sleeve.

6. The system of claim 5 wherein said outer sleeve further comprises a release element, proximate to said second engaging element, configured to disconnect said first engaging element from the second engaging element.

7. The system of claim 4, wherein said outer sleeve further comprises a third engaging element configured to releasably engage said first engaging element to prevent the slide card from fully pulled out of the outer sleeve.

8. The system of claim 3, wherein at least one of said sidewall sections includes at least one receiving aperture configured to accept at least a portion of an item.

9. The system of claim 8, wherein said top section includes at least one securing element, proximate to said aperture, configured to hold said item.

10. The system of claim 1, wherein said top wall comprises inside and outside top panels, the inside top panel being disposed between the outside top panel and the tray.

11. The system of claim 10, wherein said at least one spine support panel is foldably attached to said inside top panel and extends to a lower end thereof that is positioned adjacent to said card spine panel.

12. The system of claim 11, wherein the top cover comprises data storage means for receiving data mediums.

13. A method of resisting access to an item, comprising the steps of:

providing a slide card comprising: a base panel defined by first and second opposed edges and third and fourth opposed edges; an extension panel foldably attached to the base panel along the first edge and folded to provide a tray on the base panel; a card spine panel foldably attached to the base panel along the third edge and extending upward to a spine panel edge opposed to the third edge; a top cover foldably attached to the card spine panel along the spine panel edge and disposed over the tray; at least one spine support panel formed at least in part from the top cover, the at least one spine support panel extending downward from the top cover toward the card spine panel, wherein the extension panel comprising at least one securing section, a pair of sidewall sections, and a top section all separated by adjacent fold lines;

providing a first engaging element associated with said slide card;

providing an outer sleeve that defines a void with an open end configured to receive said slide card with tray, the outer sleeve comprising: a first side panel attached to an adjacent first spine panel, a second side panel attached to said first spine panel, a second adjacent spine panel attached to the second side panel, and at least one end panel attached to at least one of said first and second side panel; and wherein said outer sleeve defines a void configured to receive said slide card;

providing a second engaging element associated with said outer sleeve;

affixing said securing section to said base panel such that said sidewall sections are substantially parallel;

providing at least one receiving aperture in one of said sidewall panels;

placing an item in said receiving aperture;

aligning said slide card with said open end;

orienting said first engaging element with said second engagement element;

inserting said slide card fully into said void; and causing said first engaging element to releasably lock said second engaging element.

14. The method of claim 13, wherein said step of providing an outer sleeve further comprises providing a release element, proximate to said second engaging element, configured to unlock said first engaging element from the second engaging element.

15. The method of claim 14, further comprising the step of manipulating said release element to withdraw said tray at least partially from said void.

16. The method of claim 15, further comprising the step of withdrawing said item from said aperture.

17. The system of claim 10, wherein the inside top panel is folded and affixed to a face of the outside top panel.

18. The system of claim 11, wherein said at least one spine support panel is struck at least in part from the inside top panel.

19. The system of claim 11, wherein the at least one spine support panel is foldably attached to the inside top panel along at least one top cover edge spaced from the spine panel edge.

20. The system of claim 12, wherein the data storage means comprises a storage sleeve defined between the inside and outside top panels.

21. The system of claim 20, wherein the data storage means further comprises a cut line that provides as a receiving slot for the storage sleeve.

22. The system of claim 3, wherein the sidewall sections are upstanding from the base panel with the top section extending between the sidewall sections, and the at least one spine support panel is disposed adjacent to at least one of the sidewall sections.

23. The system of claim 22, wherein the at least one spine support panel comprises a pair of spine support panels which are disposed adjacent to the sidewall sections respectively.

24. The system of claim 22, wherein the slide card further comprises a second extension panel attached to the base panel along the second edge and folded to provide the tray in cooperation with the first extension panel, the second extension panel comprises at least one securing section, a pair of sidewall sections and a top section connected in series by fold lines, the sidewall sections of the second extension panel being upstanding from the base panel, and the at least one spine support panel is disposed between one of the sidewall sections of the first extension panel and one of the sidewall sections of the second extension panel.

* * * * *